US008951409B2

(12) United States Patent
Ng et al.

(10) Patent No.: US 8,951,409 B2
(45) Date of Patent: Feb. 10, 2015

(54) POLYALKYLENE EPOXY POLYAMINE ADDITIVES FOR FOULING MITIGATION IN HYDROCARBON REFINING PROCESSES

(75) Inventors: Man Kit Ng, Annandale, NJ (US); Glen B. Brons, Phillipsburg, NJ (US); Steven W. Levine, Flemington, NJ (US); Kevin Mallory, Clinton, NJ (US); Hong Cheng, East Brunswick, NJ (US); Patrick Brant, Seabrook, TX (US); Donna J. Crowther, Seabrook, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1385 days.

(21) Appl. No.: 12/642,606

(22) Filed: Dec. 18, 2009

(65) Prior Publication Data

US 2011/0147275 A1 Jun. 23, 2011

(51) Int. Cl.

| | |
|---|---|
| ***C10G 9/16*** | (2006.01) |
| ***C10G 75/04*** | (2006.01) |
| ***C10G 7/10*** | (2006.01) |
| ***C10G 29/20*** | (2006.01) |
| ***C10G 21/20*** | (2006.01) |

(52) U.S. Cl.

CPC ..... *C10G 75/04* (2013.01); *C10G 2300/4075* (2013.01); *C10G 2300/80* (2013.01)

USPC ..... 208/289; 208/48 AA; 208/290

(58) Field of Classification Search

USPC ..... 208/48 AA, 289, 290

See application file for complete search history.

(56) References Cited

U.S. PATENT DOCUMENTS

| | | | | |
|---|---|---|---|---|
| 3,235,484 | A | 2/1966 | Colfer | |
| 3,794,586 | A | 2/1974 | Kilmura et al. | |
| 4,024,051 | A | 5/1977 | Shell et al. | |
| 4,069,023 | A | 1/1978 | Brois et al. | |
| 4,302,354 | A | 11/1981 | Giede et al. | |
| 4,578,178 | A * | 3/1986 | Forester | 208/48 AA |
| 5,068,046 | A | 11/1991 | Blain et al. | |
| 5,211,834 | A | 5/1993 | Forester | |
| 5,266,186 | A * | 11/1993 | Kaplan | 208/48 AA |
| 5,962,738 | A | 10/1999 | Koehler et al. | |
| 6,140,541 | A * | 10/2000 | Melder et al. | 564/475 |
| 2007/0245621 | A1 | 10/2007 | Malfer et al. | |

FOREIGN PATENT DOCUMENTS

| | | | |
|---|---|---|---|
| EP | 0767182 | A2 | 4/1997 |
| EP | 767182 | A2 * | 4/1997 |
| GB | 1310847 | | 3/1973 |
| JP | B-S51-8966 | | 3/1976 |
| JP | A-H5-508061 | A | 9/1993 |
| JP | A-H6-504807 | A | 6/1994 |
| WO | 9212221 | A1 | 7/1992 |
| WO | 9214806 | A1 | 9/1992 |
| WO | 0000576 | | 1/2000 |

OTHER PUBLICATIONS

International Search Report, PCT Appl. No. PCT/US2009/068851, dated Jul. 8, 2010, 4 pages.

Written Opinion of the ISA, PCT Appl. No. PCT/US2009/068851, dated Jul. 8, 2010, 5 pages.

Chen, Chen-Ming, et al., "Preparation of Epoxy-modified Polyethylene by Graft Extrusion and its Applications to Polyphenylene Sulfide alloys as a Compatibilizer", Reactive & Functional Polymers 68 (2008) pp. 1307-1313.

Written Opinion, PCT Appl. No. PCT/US2009/068837, dated Apr. 1, 2010, 6 pages.

Search Report, PCT Appl. No. PCT/US2009/068837, dated Apr. 1, 2010, 4 pages.

* cited by examiner

*Primary Examiner* — Randy Boyer

(74) *Attorney, Agent, or Firm* — Glenn T. Barrett; Andrew T. Ward

(57) ABSTRACT

The present invention provides a method for reducing fouling, including particulate-induced fouling, in a hydrocarbon refining process including the steps of providing a crude hydrocarbon for a refining process and adding an antifouling agent containing a polymer base unit and a polyamine group to the crude hydrocarbon. The antifouling agent can be obtained by reacting an epoxidation reagent with a vinyl-terminated polymer, such as polypropylene or poly(ethylene-co-propylene), to form a terminal epoxy group, followed by reacting a polyamine with the epoxy group.

16 Claims, 4 Drawing Sheets

POLYALKYLENE EPOXY POLYAMINE ADDITIVES FOR FOULING MITIGATION IN HYDROCARBON REFINING PROCESSES

FIELD OF THE INVENTION

The present invention relates to additives to reduce fouling of crude hydrocarbon refinery components, and methods and systems using the same.

BACKGROUND OF THE INVENTION

Petroleum refineries incur additional energy costs, perhaps billions per year, due to fouling and the resulting attendant inefficiencies caused by the fouling. More particularly, thermal processing of crude oils, blends and fractions in heat transfer equipment, such as heat exchangers, is hampered by the deposition of insoluble asphaltenes and other contaminants (i.e., particulates, salts, etc.) that may be found in crude oils. Further, the asphaltenes and other organics are known to thermally degrade to coke when exposed to high heater tube surface temperatures.

Fouling in heat exchangers receiving petroleum-type process streams can result from a number of mechanisms including chemical reactions, corrosion, deposit of existing insoluble impurities in the stream, and deposit of materials rendered insoluble by the temperature difference ($\Delta T$) between the process stream and the heat exchanger wall. For example, naturally-occurring asphaltenes can precipitate from the crude oil process stream, thermally degrade to form a coke and adhere to the hot surfaces. Further, the high $\Delta T$ found in heat transfer operations result in high surface or skin temperatures when the process stream is introduced to the heater tube surfaces, which contributes to the precipitation of insoluble particulates. Another common cause of fouling is attributable to the presence of salts, particulates and impurities (e.g., inorganic contaminants) found in the crude oil stream. For example, iron oxide/sulfide, calcium carbonate, silica, sodium chloride and calcium chloride have all been found to attach directly to the surface of a fouled heater rod and throughout the coke deposit. These solids promote and/or enable additional fouling of crude oils.

The buildup of insoluble deposits in heat transfer equipment creates an unwanted insulating effect and reduces the heat transfer efficiency. Fouling also reduces the cross-sectional area of process equipment, which decreases flow rates and desired pressure differentials to provide less than optimal operation. To overcome these disadvantages, heat transfer equipment are ordinarily taken offline and cleaned mechanically or chemically cleaned, resulting in lost production time.

Accordingly, there is a need to reduce precipitation/adherence of particulates and asphaltenes from the heated surface to prevent fouling, and before the asphaltenes are thermally degraded or coked. This will improve the performance of the heat transfer equipment, decrease or eliminate scheduled outages for fouling mitigation efforts, and reduce energy costs associated with the processing activity.

SUMMARY OF THE INVENTION

In accordance with one aspect of the present invention, a method for reducing fouling in a hydrocarbon refining process is provided. The method comprises providing a crude hydrocarbon for a refining process, and adding an additive to the crude hydrocarbon, the additive being represented by Formula I

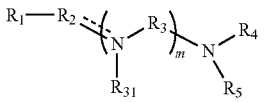

wherein $R_1$ is a branched or straight-chained $C_{10}$-$C_{800}$ alkyl or alkenyl group;

m is an integer between 1 and 10 inclusive;

$R_2$ is represented by $—CH_2—(CH_2CH_2O)_w—(CH_2)_z$-L, where w is 0 or 1, z is an integer between 0 and 6 inclusive, with the proviso that when w is 1, z is not zero;

L is selected from: (a) $—CR_{21}(OH)—CH_2—*$, wherein $R_{21}$ is hydrogen or $—CH_3$; (b) $—CH_2—CH═*$; (c) $—CH_2—CH_2—*$;

(d)

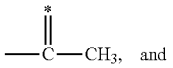

and (e)

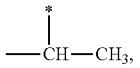

wherein the asterisks in the structures of (a), (b), (c), (d), and (e) indicate the connecting point of L with the nitrogen that connects with $R_3$, with the proviso that when L is $—CH_2—CH═*$ or

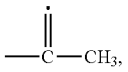

$R_{31}$ on the nitrogen that directly connects to L is absent;

$R_3$ is a $C_1$-$C_{10}$ branched or straight chained alkylene group;

$R_{31}$ is hydrogen or absent as required by valency; and $R_4$ and $R_5$ are both independently selected from hydrogen and $—R_6$-$R_7$, wherein $R_6$ is defined the same as $R_2$ above, and $R_7$ is a $C_{10}$-$C_{800}$ branched or straight chained alkyl or alkenyl group, wherein when $R_{31}$ is hydrogen, the group $—NR_{31}—$ is optionally replaced by Formula II

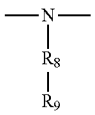

wherein $R_8$ is defined the same as $R_2$ above, and $R_9$ is branched or straight-chained $C_{10}$-$C_{800}$ alkyl or alkenyl group, or $R_8$ and $R_9$ together are a $C_1$-$C_{10}$ branched or straight chained alkyl group optionally substituted with one or more amine groups; and wherein the $—N(R_{31})—R_3—$ repeat unit is optionally interrupted in one or more places by a heterocyclic or homocyclic cycloalkyl group.

According to another aspect of the present invention, a method for reducing fouling in a hydrocarbon refining process is provided. The method comprises providing a crude hydrocarbon for a refining process, and adding an additive to the crude hydrocarbon, the additive being a reaction product of (a) a polymer base unit $R_{11}$, which is a branched or straight-chained $C_{10}$-$C_{800}$ alkyl or alkenyl group having a vinyl terminal group;

(b) an epoxidation reagent capable of converting the vinyl terminal group of $R_{11}$ to an epoxy group; and (c) a polyamine represented by Formula IV

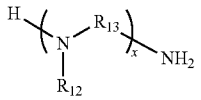

wherein $R_{12}$ is hydrogen or a $C_1$-$C_{10}$ branched or straight chained alkyl optionally substituted with one or more amine groups, $R_{13}$ is a $C_1$-$C_{10}$ branched or straight chained alkylene group, and x is an integer between 1 and 10 inclusive.

According to yet another aspect of the present invention, a method for preparing an antifoulant useful for reducing fouling in a hydrocarbon refining process is provided. The method comprises:

(a) reacting a polymer base unit $R_{11}$, which is a branched or straight-chained $C_{10}$-$C_{800}$ alkyl or alkenyl group having a vinyl terminal group, with an epoxidation reagent so as to convert the vinyl terminal group to an epoxy group;

(b) reacting the product formed in (a) with a polyamine represented by

Formula IV

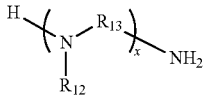

wherein $R_{12}$ is hydrogen or a $C_1$-$C_{10}$ branched or straight chained alkyl optionally substituted with one or more amine groups, $R_{13}$ is a $C_1$-$C_{10}$ branched or straight chained alkylene group, and x is an integer between 1 and 10 inclusive.

According to still another aspect of the present invention, a method for preparing an antifoulant useful for reducing fouling in a hydrocarbon refining process is provided, the method comprising:

(a) reacting a polymer base unit $R_{11}$, which is a branched or straight-chained $C_{10}$-$C_{800}$ alkyl or alkenyl group having a vinyl terminal group, with (1) an epoxidation reagent so as to convert the vinyl terminal group to a terminal epoxy group; or (2) water to convert the vinyl terminal group to form a terminal hydroxyl group, followed by reacting the product thereof containing the terminal hydroxyl group with $X—(CH_2)_s—CH(O)CH_2$ to form a product containing a terminal epoxy group, wherein X is a leaving group, and s is an integer between 1 and 6 inclusive;

(b) optionally, reducing the terminal epoxy group in the reaction product of (a)(1) to form a hydroxyl group, followed by reacting the product thereof containing the hydroxyl group with $X—(CH_2)_s—CH(O)CH_2$ to form a product containing a terminal epoxy group, wherein X is a leaving group, and s is an integer between 1 and 6 inclusive;

(c) optionally, reacting the product formed in one of (a)(1), (a)(2), or (b) with an acid to convert the terminal epoxy group of the product to an aldehyde or acetyl group;

(d) reacting the product formed in one of (a)(1), (a)(2), (b), or (c) with a polyamine represented by Formula IV

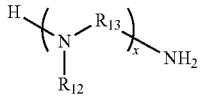

wherein $R_{12}$ is hydrogen or a $C_1$-$C_{10}$ branched or straight chained alkyl optionally substituted with one or more amine groups, $R_{13}$ is a $C_1$-$C_{10}$ branched or straight chained alkylene group, and x is an integer between 1 and 10 inclusive.

In addition, the present invention provides the additives as described in the above methods, antifouling compositions comprising such additives, and systems for refining hydrocarbons containing such additives and compositions.

BRIEF DESCRIPTION OF THE DRAWINGS

The invention will now be described in conjunction with the accompanying drawings in which.

DETAILED DESCRIPTION OF THE INVENTION

Definitions

Figure 1:
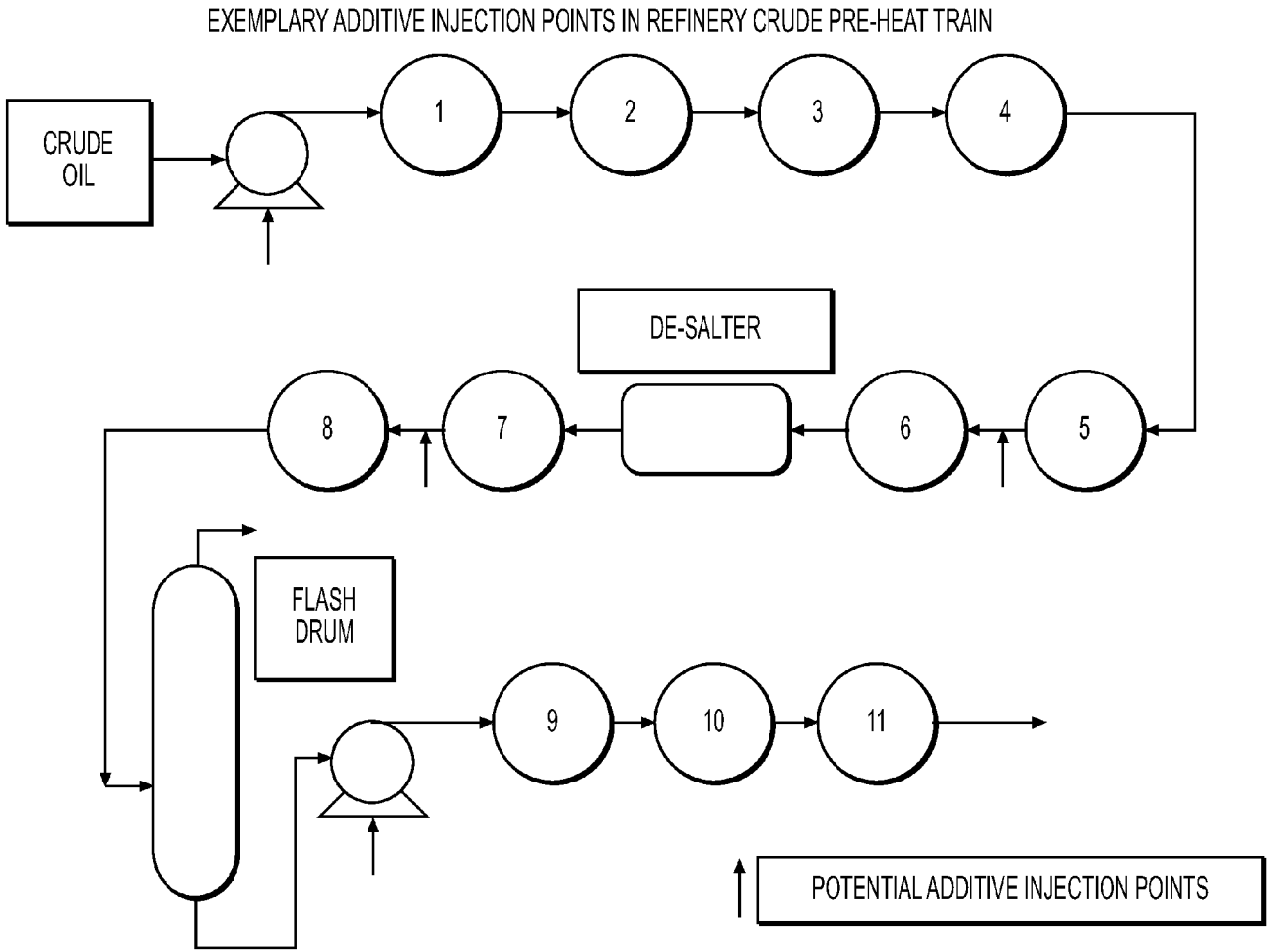
FIG. 1 is a representation of an oil refinery crude pre-heat train, annotated to show non-limiting injection points for the additives of the present invention.

The following definitions are provided for purpose of illustration and not limitation.

As used herein, the term "fouling" generally refers to the accumulation of unwanted materials on the surfaces of processing equipment or the like, particularly processing equipment in a hydrocarbon refining process.

As used herein, the term "particulate-induced fouling" generally refers to fouling caused primarily by the presence of variable amounts of organic or inorganic particulates. Organic particulates (such as precipitated asphaltenes and coke particles) include, but are not limited to, insoluble matter precipitated out of solution upon changes in process conditions (e.g., temperature, pressure, or concentration changes) or a change in the composition of the feed stream (e.g., changes due to the occurrence of a chemical reaction). Inorganic particulates include, but are not limited to, silica, iron oxide, iron sulfide, alkaline earth metal oxide, sodium chloride, calcium chloride and other inorganic salts. One major source of these particulates results from incomplete solids removal during desalting and/or other particulate removing processes. Solids promote the fouling of crude oils and blends due to physical effects by modifying the surface area of heat transfer equipment, allowing for longer holdup times at wall temperatures and causing coke formation from asphaltenes and/or crude oil(s).

As used herein, the term "alkyl" refers to a monovalent hydrocarbon group containing no double or triple bonds and arranged in a branched or straight chain.

As used herein, the term "alkylene" refers to a divalent hydrocarbon group containing no double or triple bonds and arranged in a branched or straight chain.

As used herein, the term "alkenyl" refers to a monovalent hydrocarbon group containing one or more double bonds and arranged in a branched or straight chain.

As used herein, a "hydrocarbyl" group refers to any univalent radical that is derived from a hydrocarbon, including univalent alkyl, aryl and cycloalkyl groups.

As used herein, the term "crude hydrocarbon refinery component" generally refers to an apparatus or instrumentality of a process to refine crude hydrocarbons, such as an oil refinery process, which is, or can be, susceptible to fouling. Crude hydrocarbon refinery components include, but are not limited to, heat transfer components such as a heat exchanger, a furnace, a crude preheater, a coker preheater, or any other heaters, a FCC slurry bottom, a debutanizer exchanger/tower, other feed/effluent exchangers and furnace air preheaters in refinery facilities, flare compressor components in refinery facilities and steam cracker/reformer tubes in petrochemical facilities. Crude hydrocarbon refinery components can also include other instrumentalities in which heat transfer can take place, such as a fractionation or distillation column, a scrubber, a reactor, a liquid-jacketed tank, a pipestill, a coker and a visbreaker. It is understood that "crude hydrocarbon refinery components," as used herein, encompasses tubes, piping, baffles and other process transport mechanisms that are internal to, at least partially constitute, and/or are in direct fluid communication with, any one of the above-mentioned crude hydrocarbon refinery components.

As used herein, a reduction (or "reducing") particulate-induced fouling is generally achieved when the ability of particulates to adhere to heated equipment surfaces is reduced, thereby mitigating their impact on the promotion of the fouling of crude oil(s), blends, and other refinery process streams.

As used herein, reference to a group being a particular polymer (e.g., polypropylene or poly(ethylene-co-propylene) encompasses polymers that contain primarily the respective monomer along with negligible amounts of other substitutions and/or interruptions along polymer chain. In other words, reference to a group being a polypropylene group does not require that the group consist of 100% propylene monomers without any linking groups, substitutions, impurities or other substituents (e.g., alkylene or alkenylene substituents). Such impurities or other substituents can be present in relatively minor amounts so long as they do not affect the industrial performance of the additive, as compared to the same additive containing the respective polymer substituent with 100% purity.

For the purposes of this invention and the claims thereto when a polymer is referred to as comprising an olefin, the olefin present in the polymer is the polymerized form of the olefin.

As used herein, a copolymer is an polymer comprising at least two different monomer units (such as propylene and ethylene). A homo-polymer is an polymer comprising units of the same monomer (such as propylene). A propylene polymer is a polymer having at least 50 mole % of propylene.

The term "vinyl termination", also referred to as "allyl chain end(s)" or "vinyl content" is defined to be a polymer having at least one terminus represented by formula I:

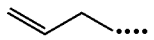

allylic vinyl end group where the "...." represents the polymer chain.

In a preferred embodiment the allyl chain end is represented by the formula II:

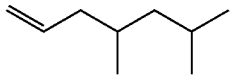

allylic vinyl end group

The amount of allyl chain ends (also called % vinyl termination) is determined using $^{1}H$ NMR at 120° C. using deuterated tetrachloroethane as the solvent on a 500 MHz machine and in selected cases confirmed by $^{13}C$ NMR. Resconi has reported proton and carbon assignments (neat perdeuterated tetrachloroethane used for proton spectra while a 50:50 mixture of normal and perdeuterated tetrachloroethane was used for carbon spectra; all spectra were recorded at 100° C. on a Bruker AM 300 spectrometer operating at 300 MHz for proton and 75.43 MHz for carbon) for vinyl terminated propylene polymers in J American Chemical Soc 114 1992, 1025-1032, hereby incorporated by reference in its entirety, that are useful herein.

"Isobutyl chain end" is defined to be a polymer having at least one terminus represented by the formula:

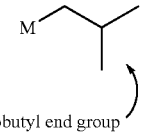

isobutyl end group where M represents the polymer chain. In a preferred embodiment, the isobutyl chain end is represented by one of the following formulae:

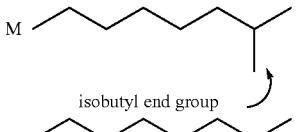

isobutyl end group

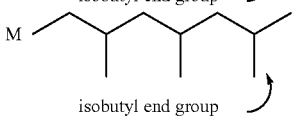

isobutyl end group

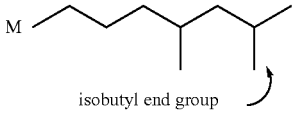

isobutyl end group

-continued

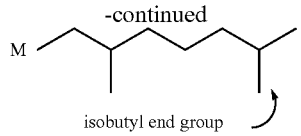

where M represents the polymer chain.

The percentage of isobutyl end groups is determined using $^{13}C$ NMR (as described in the example section of Ser. No. 12/488,066, filed Jun. 19, 2009) and the chemical shift assignments in Resconi et al, J Am. Chem. Soc. 1992, 114, 1025-1032 for 100% propylene polymers and set forth in FIG. 2 for E-P polymers.

The "isobutyl chain end to allylic vinyl group ratio" is defined to be the ratio of the percentage of isobutyl chain ends to the percentage of allylic vinyl groups.

A reaction zone is any vessel where a reaction occurs, such as glass vial, a polymerization reactor, reactive extruder, tubular reactor and the like.

As used herein, the term "polymer" refers to a chain of monomers having a Mn of 100 g/mol and above.

Reference will now be made to various aspects of the present invention in view of the definitions above.

The techniques provided herein are based, at least in part, on interactions between the antifouling additives according to the invention and the materials in crude oils that are prone to cause fouling, e.g., particulate impurities/contaminants and asphaltenes. The interaction can be of physical or chemical means such as absorption, association, or chemical bonding. The fouling materials can be rendered more soluble in the crude oils as a result of interaction with the antifouling additives, therefore the fouling on the exchanger metal surfaces can be reduced or eliminated.

In accordance with one aspect of the present invention, a method is provided for reducing fouling. The method includes providing a crude hydrocarbon for a refining process, and adding to the crude hydrocarbon one or more additives (also referred to as antifouling agent or antifoulant) selected from:

Formula I

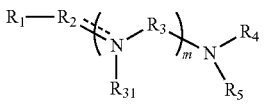

wherein $R_1$ is a branched or straight-chained $C_{10}$-$C_{800}$ alkyl or alkenyl group;

m is an integer between 1 and 10 inclusive;

$R_2$ is represented by $—CH_2—(CH_2CH_2O)_w—(CH_2)_z$-L, where w is 0 or 1, z is an integer between 0 and 6 inclusive, with the proviso that when w is 1, z is not zero;

L is selected from: (a) $—CR_{21}(OH)—CH_2—*$, wherein $R_{21}$ is hydrogen or $—CH_3$; (b) $—CH_2—CH═*$; (c) $—CH_2—CH_2—*$;

(d)

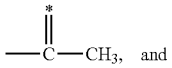

and

-continued (e)

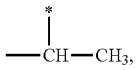

wherein the asterisks in the structures of (a), (b), (c), (d), and (e) indicate the connecting point of L with the nitrogen that connects with $R_3$, with the proviso that when L is $—CH_2—CH═*$ or

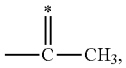

$R_{31}$ on the nitrogen that directly connects to L is absent;

$R_3$ is a $C_1$-$C_{10}$ branched or straight chained alkylene group;

$R_{31}$ is hydrogen or absent as required by valency; and $R_4$ and $R_5$ are both independently selected from the group from hydrogen and $—R_6$-$R_7$, wherein $R_6$ is defined the same as $R_2$ above, and $R_7$ is a $C_{10}$-$C_{100}$ branched or straight chained alkyl or alkenyl group, wherein when $R_{31}$ is hydrogen, the group $—NR_{31}—$ is optionally replaced by Formula II

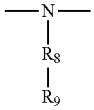

wherein $R_8$ is defined the same as $R_2$ above, and $R_9$ is branched or straight-chained $C_{10}$-$C_{800}$ alkyl or alkenyl group, or $R_8$ and $R_9$ together are a $C_1$-$C_{10}$ branched or straight chained alkyl group optionally substituted with one or more amine groups; and wherein the $—N(R_{31})—R_3—$ repeat unit is optionally interrupted in one or more places by a heterocyclic or homocyclic cycloalkyl group.

In certain embodiments, at least one of $R_1$, $R_7$, and $R_9$ of Formula I comprises polypropylene (PP), which can be either atactic polypropylene or isotactic polypropylene. In an alternative embodiment, at least one of $R_1$, $R_7$, and $R_9$ of the additive of Formula I comprises polyethylene (PE).

In a further embodiment, at least one of $R_1$, $R_7$, and $R_9$ of the additive of Formula I comprises poly(ethylene-co-propylene) (EP). The mole percentage of the ethylene units and propylene units in the poly(ethylene-co-propylene) can vary. For example, in some embodiments, the poly(ethylene-co-propylene) can contain about 10 to about 90 mole % of ethylene units and about 90 to about 10 mole % propylene units. In certain embodiments, the poly(ethylene-co-propylene) contains about 20 to about 50 mole % of ethylene units.

In some embodiments of the above method, at least one of $R_1$, $R_7$, and $R_9$ of the additive of Formula I has a number-averaged molecular weight of from about 300 to about 30,000 g/mol (assuming one olefin unsaturation per chain, as measured by $^1H$ NMR). Alternatively, at least one of $R_1$, $R_7$, and $R_9$ of the additive of Formula I has a number-averaged molecular weight of from about 500 to 5,000 g/mol. In one embodiment, the PP or EP included in the $R_1$, $R_7$ or $R_9$ of the additive Formula I, individually, have a molecular weight from about 300 to about 30,000 g/mol, or from about 500 to about 5000 g/mol. In one embodiment, the PP or EP groups have a molecular weight, individually, ranging from about 500 to about 2500 g/mol, or a molecular of from about 500 to about 650 g/mol, or a molecular weight of from about 800 to about 1000 g/mol, or a molecular weight of from about 2000 to about 2500 g/mol.

In particular embodiments, the additive of Formula I in the above method is represented by Formula III

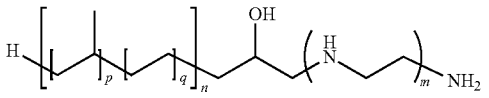

wherein p and q are both independently 0 or 1, provided that p and q are not both 0, n is an integer between 5 to 1000, and m is an integer between 1 and 10 inclusive.

In certain embodiments of the above method, the nitrogen content in the additive of Formula I is about 1 wt % to about 10 wt % based on the total weight of the additive.

In accordance with another aspect of the present invention, a method is provided for reducing fouling. The method includes providing a crude hydrocarbon for a refining process, and adding to the crude hydrocarbon one or more additives which are a reaction product of (a) a polymer base unit $R_{11}$, which is a branched or straight-chained $C_{10}$-$C_{800}$ alkyl or alkenyl group having a vinyl terminal group;

(b) an epoxidation reagent capable of converting the vinyl terminal group of $R_{11}$ to an epoxy group; and (c) a polyamine represented by Formula IV

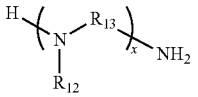

wherein $R_{12}$ is hydrogen or a $C_1$-$C_{10}$ branched or straight chained alkyl optionally substituted with one or more amine groups, $R_{13}$ is a $C_1$-$C_{10}$ branched or straight chained alkylene group, and x is an integer between 1 and 10 inclusive.

In specific embodiments of the above method, the polyamine of the above methods is diethylenetriamine (DETA), triethylenetetramine (TETA), tetraethylenepentamine (TEPA), or pentaethylenehexamine (PEHA), hexaethyleneheptamine (HEHA), or higher molecular weight species. These polyamines can further contain a complex mixture of various linear, cyclic, and branched structures. For example, a commercially available polyamine known as Heavy Polyamine X (HPA-X), from Dow Chemical, can be used.

In some embodiments, the mole ratio between the polymer base unit $R_{11}$ and polyamine is about 2:1 or about 1:1.

In certain embodiments of the above method, the polymer base unit $R_{11}$ has a number-averaged molecular weight of 300 to 30,000 g/mol (assuming one olefin unsaturation per chain, as measured by $^1$H NMR), and alternatively, about 500 to 5,000 g/mol.

In some embodiments of the above method, the polymer base unit $R_{11}$ comprises polypropylene. The polypropylene can be either atactic polypropylene or isotactic polypropylene. The polymer base unit $R_{11}$ can also comprise polyethylene.

In alternative embodiments, the polymer base unit $R_{11}$ comprises poly(ethylene-co-propylene). The poly(ethylene-co-propylene) can contain from about 1 or 10 mole % to about 90 or 99 mole % of ethylene units and from about 99 or 90 mole % to about 10 or 1 mole % propylene units. In one embodiment, the poly(ethylene-co-propylene) polymer contains from about 2 or 20 mole % to about 50 mole % ethylene units.

In one embodiment, the PP or EP included in the $R_{11}$ of the additive Formula I, individually, have a number-averaged molecular weight ($M_n$) molecular weight from about 300 to about 30,000 g/mol, or from about 500 to about 5000 g/mol (assuming one olefin unsaturation per chain, as measured by $^1$H NMR). In one embodiment, the PP or EP groups have a molecular weight, individually, ranging from about 500 to about 2500 g/mol, or a molecular of from about 500 to about 650 g/mol, or a molecular weight of from about 800 to about 1000 g/mol, or a molecular weight of from about 2000 to about 2500 g/mol.

In embodiments where the polymer base unit $R_{11}$ include polypropylene or poly(ethylene-co-propylene), such groups can be prepared, for example, by metallocene-catalyzed polymerization of propylene or a mixture of ethylene and propylene, which are then terminated with a high vinyl group content in the chain end. The number-averaged molecular weight ($M_n$) of the PP or EP can be from about 300 to about 30,000 g/mol, as determined by $^1$H NMR spectroscopy. The vinyl-terminated atactic or isotactic polypropylenes (v-PP) or vinyl-terminated poly(ethylene-co-propylene) (v-EP) suitable for further chemical functionalization can have a molecular weight ($M_n$) approximately from about 300 to about 30,000 g/mol, and preferably about 500 to 5,000 g/mol. The terminal olefin group can be a vinylidene group or an allylic vinyl group (both covered in Formula I). In certain embodiments, the terminal olefin group is an allylic vinyl group. In this regard, the terminal allylic vinyl group rich PP or EP as disclosed in co-pending application, U.S. app. Ser. No. 12/143,663, can be used, which application is hereby incorporated by reference in its entirety. Some of the vinyl terminated EP or PP according to this co-pending application contains more than 90% of allylic terminal vinyl group.

In another embodiment, one or more of the $R_1$, $R_7$ and $R_{10}$ groups is independently selected from the group consisting of propylene polymers comprising propylene and less than 0.5 wt % comonomer, preferably 0 wt % comonomer, wherein the polymer has:

i) at least 93% allyl chain ends (preferably at least 95%, preferably at least 97%, preferably at least 98%);

ii) a number average molecular weight (Mn) of about 500 to about 20,000 g/mol, as measured by $^1$H NMR, assuming one olefin unsaturation per chain (preferably 500 to 15,000, preferably 700 to 10,000, preferably 800 to 8,000 g/mol, preferably 900 to 7,000, preferably 1000 to 6,000, preferably 1000 to 5,000);

iii) an isobutyl chain end to allylic vinyl group ratio of 0.8:1 to 1.3:1.0;

iv) less than 1400 ppm aluminum, (preferably less than 1200 ppm, preferably less than 1000 ppm, preferably less than 500 ppm, preferably less than 100 ppm).

In another embodiment, one or more of the $R_1$, $R_7$ and $R_{10}$ groups is independently selected from the group consisting of propylene copolymers having an Mn of 300 to 30,000 g/mol as measured by 1H NMR and assuming one olefin unsaturation per chain (preferably 400 to 20,000, preferably 500 to 15,000, preferably 600 to 12,000, preferably 800 to 10,000, preferably 900 to 8,000, preferably 900 to 7,000 g/mol), comprising 10 to 90 mol % propylene (preferably 15 to 85 mol %, preferably 20 to 80 mol %, preferably 30 to 75 mol %, preferably 50 to 90 mol %) and 10 to 90 mol % (preferably 85 to 15 mol %, preferably 20 to 80 mol %, preferably 25 to 70 mol %, preferably 10 to 50 mol %) of one or more alpha-olefin comonomers (preferably ethylene, butene, hexene, or octene, preferably ethylene), wherein the polymer has at least X % allyl chain ends (relative to total unsaturations), where: 1) X=(−0.94 (mole % ethylene incorporated)+100 {alternately 1.20 (−0.94 (mole % ethylene incorporated)+100), alternately 1.50(−0.94 (mole % ethylene incorporated)+100)}), when 10 to 60 mole % ethylene is present in the co-polymer, and 2) X=45 (alternately 50, alternately 60), when greater than 60 and less than 70 mole % ethylene is present in the co-polymer, and 3) X=(1.83* (mole % ethylene incorporated)−83, {alternately 1.20 [1.83* (mole % ethylene incorporated)−83], alternately 1.50 [1.83*(mole % ethylene incorporated)−83]}), when 70 to 90 mole % ethylene is present in the copolymer. Alternately X is 80% or more, preferably 85% or more, preferably 90% or more, preferably 95% or more.

Alternatively, the polymer or copolymer has at least 80% isobutyl chain ends (based upon the sum of isobutyl and n-propyl saturated chain ends), preferably at least 85% isobutyl chain ends, preferably at least 90% isobutyl chain ends. Alternately, the polymer has an isobutyl chain end to allylic vinyl group ratio of 0.8:1 to 1.35:1.0, preferably 0.9:1 to 1.20:1.0, preferably 0.9:1.0 to 1.1:1.0.

In another embodiment, one or more of the $R_1$, $R_7$ and $R_{10}$ groups is independently selected from the group consisting of propylene polymers, comprising more than 90 mol % propylene (preferably 95 to 99 mol %, preferably 98 to 9 mol %) and less than 10 mol % ethylene (preferably 1 to 4 mol %, preferably 1 to 2 mol %), wherein the polymer has:

at least 93% allyl chain ends (preferably at least 95%, preferably at least 97%, preferably at least 98%);

a number average molecular weight (Mn) of about 400 to about 30,000 g/mol, as measured by $^1$H NMR and assuming one olefin unsaturation per chain (preferably 500 to 20,000, preferably 600 to 15,000, preferably 700 to 10,000 g/mol, preferably 800 to 9,000, preferably 900 to 8,000, preferably 1000 to 6,000);

an isobutyl chain end to allylic vinyl group ratio of 0.8:1 to 1.35:1.0, and less than 1400 ppm aluminum, (preferably less than 1200 ppm, preferably less than 1000 ppm, preferably less than 500 ppm, preferably less than 100 ppm).

In another embodiment, one or more of the $R_1$, $R_7$ and $R_{10}$ groups is independently selected from the group consisting of propylene polymers comprising:

at least 50 (preferably 60 to 90, preferably 70 to 90) mol % propylene and from 10 to 50 (preferably 10 to 40, preferably 10 to 30) mol % ethylene, wherein the polymer has:

at least 90% allyl chain ends (preferably at least 91%, preferably at least 93%, preferably at least 95%, preferably at least 98%);

an Mn of about 150 to about 20,000 g/mol, as measured by $^1$H NMR and assuming one olefin unsaturation per chain (preferably 200 to 15,000, preferably 250 to 15,000, preferably 300 to 10,000, preferably 400 to 9,500, preferably 500 to 9,000, preferably 750 to 9,000); and an isobutyl chain end to allylic vinyl group ratio of 0.8:1 to 1.3:1.0, wherein monomers having four or more carbon atoms are present at from 0 to 3 mol % (preferably at less than 1 mol %, preferably less than 0.5 mol %, preferably at 0 mol %).

In another embodiment, one or more of the $R_1$, $R_7$ and $R_{10}$ groups is independently selected from the group consisting of propylene polymers comprising:

at least 50 (preferably at least 60, preferably 70 to 99.5, preferably 80 to 99, preferably 90 to 98.5) mol % propylene, from 0.1 to 45 (preferably at least 35, preferably 0.5 to 30, preferably 1 to 20, preferably 1.5 to 10) mol % ethylene, and from 0.1 to 5 (preferably 0.5 to 3, preferably 0.5 to 1) mol % $C_4$ to $C_{12}$ olefin (such as butene, hexene or octene, preferably butene), wherein the polymer has:

at least 90% allyl chain ends (preferably at least 91%, preferably at least 93%, preferably at least 95%, preferably at least 98%);

a number average molecular weight (Mn) of about 150 to about 15,000 g/mol, as measured by $^1$H NMR and assuming one olefin unsaturation per chain (preferably 200 to 12,000, preferably 250 to 10,000, preferably 300 to 10,000, preferably 400 to 9500, preferably 500 to 9,000, preferably 750 to 9,000); and an isobutyl chain end to allylic vinyl group ratio of 0.8:1 to 1.35:1.0.

In another embodiment, one or more of the $R_1$, $R_7$ and $R_{10}$ groups is independently selected from the group consisting of propylene polymers comprising:

at least 50 (preferably at least 60, preferably 70 to 99.5, preferably 80 to 99, preferably 90 to 98.5) mol % propylene, from 0.1 to 45 (preferably at least 35, preferably 0.5 to 30, preferably 1 to 20, preferably 1.5 to 10) mol % ethylene, and from 0.1 to 5 (preferably 0.5 to 3, preferably 0.5 to 1) mol % diene (such as $C_4$ to $C_{12}$ alpha-omega dienes (such as butadiene, hexadiene, octadiene), norbornene, ethylidene norbornene, vinylnorbornene, norbornadiene, and dicyclopentadiene), wherein the polymer has:

at least 90% allyl chain ends (preferably at least 91%, preferably at least 93%, preferably at least 95%, preferably at least 98%);

a number average molecular weight (Mn) of about 150 to about 20,000 g/mol, as measured by $^1$H NMR and assuming one olefin unsaturation per chain (preferably 200 to 15,000, preferably 250 to 12,000, preferably 300 to 10,000, preferably 400 to 9,500, preferably 500 to 9,000, preferably 750 to 9,000); and an isobutyl chain end to allylic vinyl group ratio of 0.7:1 to 1.35:1.0.

Any of the propylene polymers prepared herein preferably have less than 1400 ppm aluminum, preferably less than 1000 ppm aluminum, preferably less than 500 ppm aluminum, preferably less than 100 ppm aluminum, preferably less than 50 ppm aluminum, preferably less than 20 ppm aluminum, preferably less than 5 ppm aluminum.

The terminal allylic vinyl functionality in the PP or EP described above can be quantitatively epoxidized by an epoxidation reagent, for example, a stoichiometric amount of an organic peroxy acid such as m-chloroperoxybenzoic acid (MCPBA) between 0 and 25° C. in an organic solvent. (A terminal vinylidene group can be similarly epoxidized to provide an internal epoxide group.) Such reaction yields a functionalized PP or EP with an epoxide end group with excellent chemoselectivity and efficiency in high yield (e.g., >95%). The is particularly advantageous because the mild conditions required for this transformation can result in significant cost savings when compared to maleation used for introduction of a succinic anhydride group to the PP or EP where operating temperatures in the range of 180 to 200° C. are typically employed.

In the above reaction, the epoxidation reagent need not be an organic peroxy acid, and can alternatively be, for example, a combination of stoichiometric molecular oxygen, hydrogen peroxide, or alkyl hydroperoxide along with a suitable epoxidation catalyst such as metalloporphyrin. Other epoxidation catalysts can be used, such as transition metal zeolites such as those derived form titanium silicate zeolites, as disclosed in U.S. Pat. No. 7,381,675. Moreover, sodium hypochlorite (NaOCl) and a manganese (III) Schiff base catalyst is another example of the epoxidation catalyst (see E. N. Jacobsen, W. Zhang, A. R. Muci, J. R. Ecker, L. Deng, *J. Am. Chem. Soc.*, 1991, 113, 7063-7064).

Addition of polyamines (PAM) (for example, ethyleneamine oligomers such as diethylenetriamine, triethylenetetramine, tetraethylenepentamine, and pentaethylenehexamine) with varying chain length and number of amine functional group to the epoxide functionality in the polypropylene or poly(ethylene-co-propylene) chain end can yield final reaction products of polypropylene epoxy polyamines (PPE-PAMs or PP-E-PAMs) or poly(ethylene-co-propylene) polyamines (EPE-PAMs or EP-E-PAMs), as schematically illustrated below.

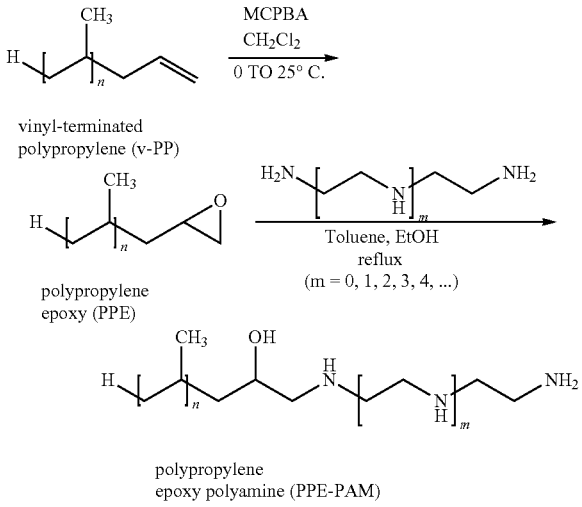

By selecting vinyl-terminated polypropylene or poly(ethylene-co-propylene) of different molecular weights and polyamines of different chain lengths and molecular composition (e.g., ethyleneamine oligomers with a general formula of $H_2N—(CH_2CH_2NH)_m—CH_2CH_2—NH_2$ or propyleneamine oligomers with a formula of $H_2N—(CH_2CH_2CH_2NH)_m—CH_2CH_2CH_2—NH_2$ where m=0, 1, 2, 3, 4, . . . ), these additives can be molecularly designed to have different amount of basic nitrogen contents and hence varying degrees of dispersancy in crude oil. Without being bound by any particular theory, the polar head groups (i.e., polyamine) in the PP-E-PAM or EP-E-PAM are believed to be at least partially responsible for their ability to disperse particulates in crude oils.

The epoxy terminal group can be optionally modified before reaction with the PAM. For example, the epoxy can be first reduced to produce a terminal hydroxyl group. In the alternative, the vinyl terminated polymer base unit can directly be hydrated (by water) to produce the same terminal hydroxyl group, without going through the epoxidation step. The terminal hydroxyl group can then be reacted with epichlorohydrin ($Cl—CH_2—CH(O)CH_2$) and a base to form a glycidyl ether functionality at the polymer chain end. The resulting glycidyl ether can then react with PAM to form a linkage. Analogously, one can choose from a more general alkylating agent with the general formula $X—(CH_2)_s—CH(O)CH_2$ and use it to react with a hydroxyl-terminated polymer, where X is a leaving group, such as a halogen (e.g., Cl, Br, or I) or p-toluenesulfonate. This reaction is illustrated below:

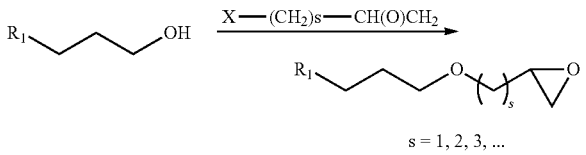

Further, before adding a PAM, the epoxide end group, optionally modified by the above illustrated reactions, can also be converted to other functional groups including aldehyde and ketone. The reaction to convert an epoxy group to ketone or aldehyde is an acid-catalyzed rearrangement/isomerization reaction, where the acid can be a Lewis acid catalyst, for example, boron trifluoride. A PAM can then react with the aldehyde or ketone by a reductive amination. Using diethylenetriamine as an example (any other PAMs described above can also be used), these reactions can be illustrated as follows:

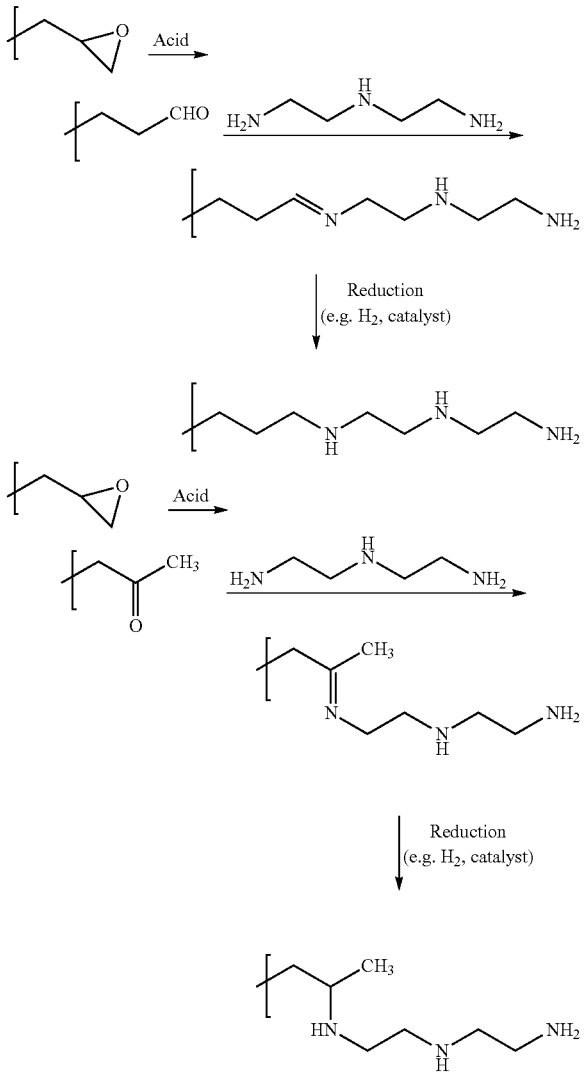

A few representative examples illustrating the effects of molecular weight variation, type of polyamine used and stoichiometry to give polypropylene epoxy polyamine composition with different level of theoretical basic nitrogen content are shown in the following table. The level of basic nitrogen can be controlled to provide a wide range of values (from about 3 to about 10% in the Table below, but the range can be broader such as 1%-20%) on a weight basis in the resulting dispersant additives.

| Entry | NMR-averaged MW of v-PP [a] (g/mol) | PAM [b] | PP-E [c]:PAM | Theoretical Basic Nitrogen content (wt %) |
|---|---|---|---|---|
| 1 | 983.0 | TEPA | 2:1 | 3.2 |
| 2 | 983.0 | PEHA | 2:1 | 3.8 |
| 3 | 570.7 | TEPA | 2:1 | 5.1 |
| 4 | 570.7 | PEHA | 2:1 | 6.0 |
| 5 | 983.0 | TEPA | 1:1 | 5.9 |
| 6 | 983.0 | PEHA | 1:1 | 6.8 |
| 7 | 570.7 | TEPA | 1:1 | 9.0 |
| 8 | 570.7 | PEHA | 1:1 | 10.3 |

[a] v-PP = vinyl-terminated polypropylene

[b] PAM = polyamine, TEPA = tetraethylenepentamine, PEHA = pentaethylenehexamine

[c] PP-E = polypropylene epoxy

In accordance with yet another aspect of the present invention, a method is provided for preparing an antifoulant useful for reducing fouling in a hydrocarbon refining process. The method includes:

(a) reacting a polymer base unit $R_{11}$, which is a branched or straight-chained $C_{10}$-$C_{800}$ alkyl or alkenyl group having a vinyl terminal group, with an epoxidation reagent so as to convert the vinyl terminal group to an epoxy group;

(b) reacting the product formed in (a) with a polyamine represented by

Formula IV

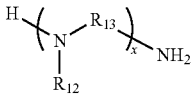

wherein $R_{12}$ is hydrogen or a $C_1$-$C_{10}$ branched or straight chained alkyl optionally substituted with one or more amine groups, $R_{13}$ is a $C_1$-$C_{10}$ branched or straight chained alkylene group, and x is an integer between 1 and 10 inclusive.

The polymer base unit $R_{11}$ can include, for example, polypropylene (PP), polyethylene (PE) or poly(ethylene-co-propylene) (EP). The epoxidation reagent can include, for example, an organic peroxy acid such as m-chloroperoxybenzoic acid, or the combination of (A) one of molecular oxygen, hydrogen peroxide, or alkyl hydroperoxide; and (B) an epoxidation catalyst, such as metalloporphyrin, a transition metal zeolite or a transition metal complex. The polyamine can be, for example, diethylenetriamine (DETA), triethylenetetramine (TETA), tetraethylenepentamine (TEPA), or pentaethylenehexamine (PEHA). These polyamines can further contain a complex mixture of various linear, cyclic, and branched structures. For example, a commercially available polyamine known as Heavy Polyamine X (HPA-X), from Dow Chemical, can be used.

In specific embodiments, the antifoulant prepared by the above method is represented by Formula III

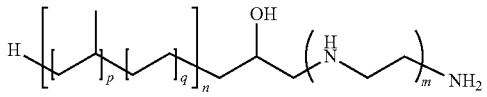

wherein p and q are both independently 0 or 1, provided that p and q are not both 0, n is an integer between 5 to 1000, and m is an integer between 1 and 10 inclusive.

Another aspect of the present invention provides a system for refining hydrocarbons that includes at least one crude hydrocarbon refinery component, in which the crude hydrocarbon refinery component includes an additive selected from any one of the additives described herein. The crude hydrocarbon refining component can be selected from a heat exchanger, a furnace, a crude preheater, a coker preheater, a FCC slurry bottom, a debutanizer exchanger, a debutanizer tower, a feed/effluent exchanger, a furnace air preheater, a flare compressor component, a steam cracker, a steam reformer, a distillation column, a fractionation column, a scrubber, a reactor, a liquid-jacketed tank, a pipestill, a coker, and a visbreaker. In one preferred embodiment, the crude hydrocarbon refining component is a heat exchanger (e.g., a crude pre-heat train heat exchanger).

Another aspect of the present invention provides a composition for reducing fouling that includes at least one of any of the above-described additives, and a boronating agent. The boronating agent can be any one or more compounds selected from boric acid, an ortho-borate, or a meta-borate, for example, boric acid, trimethyl metaborate (trimethoxyboroxine), triethyl metaborate, tributyl metaborate, trimethyl borate, triethylborate, triisopropyl borate (triisopropoxyborane), tributyl borate (tributoxyborane) and tri-t-butyl borate. Other boronating agents can be used, such as those disclosed in co-pending application U.S. Ser. No. 12/533,465, filed Jul. 31, 2009, and hereby incorporated by reference in its entirety.

In a preferred embodiment, the synthesis processes described herein are continuous processes. As used herein the term continuous means a system that operates without interruption or cessation. For example a continuous process to produce a polymer would be one where the reactants are continually introduced into one or more reactors and polymer product is continually withdrawn.

Further Compositions for Reducing Fouling

The additives of the present invention can be used in compositions that prevent fouling, including particulate-induced fouling. In addition to the additives of the present invention, the compositions can further contain a hydrophobic oil solubilizer for the additive and/or a dispersant for the additive.

Suitable solubilizers can include, for example, surfactants, carboxylic acid solubilizers, such as the nitrogen-containing phosphorous-free carboxylic solubilizers disclosed in U.S. Pat. No. 4,368,133, hereby incorporated by reference in its entirety.

Also as disclosed in U.S. Pat. No. 4,368,133, hereby incorporated by reference in its entirety, surfactants that can be included in compositions of the present invention can include, for example, cationic, anionic, nonionic or amphoteric type of surfactant. See, for example, McCutcheon's "Detergents and Emulsifiers", 1978, North American Edition, published by McCutcheon's Division, MC Publishing Corporation, Glen Rock, N.J., U.S.A., including pages 17-33, which is hereby incorporated by reference in its entirety.

The compositions of the present invention can further include, for example, viscosity index improvers, anti-foamants, antiwear agents, demulsifiers, anti-oxidants, and other corrosion inhibitors.

Furthermore, the additives of the present invention can be added with other compatible components that address other problems that can present themselves in an oil refining process known to one of ordinary skill in the art.

Uses of the Additives and Compositions of the Present Invention in a Refinery Process The additives of the present invention are generally soluble in a typical hydrocarbon refinery stream and can thus be added directly to the process stream, alone or in combination with other additives that either reduce fouling or improve some other process parameter.

The additives can be introduced, for example, upstream from the particular crude hydrocarbon refinery component(s) (e.g., a heat exchanger) in which it is desired to prevent fouling (e.g. particulate-induced fouling). Alternatively, the additive can be added to the crude oil prior to being introduced to the refining process, or at the very beginning of the refining process.

It is noted that water can have a negative impact on boron-containing additives. Accordingly, it is advisable to add boron-containing additives at process locations that have a minimal amount of water.

While not limited thereto, the additives of the present invention are particularly suitable in reducing or preventing particulate-induced fouling. Thus one aspect of the present invention provides a method of reducing and/or preventing, in particular, particulate-induced fouling that includes adding at least one additive of the present invention to a process stream that is known, or believed to contribute to, particulate-induced fouling. To facilitate determination of proper injection points, measurements can be taken to ascertain the particulate level in the process stream. Thus, one embodiment of the present invention includes identifying particular areas of a refining process that have relatively high particulate levels, and adding any one of the additives of the present invention in close proximity to these areas (e.g., just upstream to the area identified as having high particulate levels).

In one embodiment of the present invention, a method to reduce fouling is provided comprising adding any one of the above-mentioned antifouling additives or compositions to a crude hydrocarbon refinery component that is in fluid communication with a process stream that contains, at least 50 wppm of particulates, including organic and inorganic particulates. In another embodiment of the present invention, a method to reduce fouling is provided comprising adding any one of the above-mentioned antifouling additives or compositions to a crude hydrocarbon refinery component that is in fluid communication with a process stream. In another embodiment of the present invention, a method to reduce fouling is provided comprising adding any one of the above-mentioned additives to a crude hydrocarbon refinery component that is in fluid communication with a process stream that contains at least 250 wppm (or 1000 wppm, or 10,000 wppm) of particulates, including organic and inorganic particulates, as defined above.

In one embodiment of the present invention, the additives or compositions of the present invention are added to selected crude oil process streams known to contain, or possibly contain, problematic amounts of organic or inorganic particulate matter (e.g. 1-10,000 wppm), such as inorganic salts. Accordingly, the additives of the present invention can be introduced far upstream, where the stream is relatively unrefined (e.g. the refinery crude pre-heat train). The additives can be also added, for example, after the desalter to counteract the effects of incomplete salt removal or to the bottoms exit stream from the fractionation column to counteract the high temperatures that are conducive to fouling.

FIG. 1 demonstrates possible additive injection points within the refinery crude pre-heat train for the additives of the present invention, wherein the numbered circles represent heat exchangers. As shown in FIG. 1, the additives can be introduced in crude storage tanks and at several locations in the preheat train. This includes at the crude charge pump (at the very beginning of the crude pre-heat train), and/or before and after the desalter, and/or to the bottoms stream from a flash drum.

The total amount of additive to be added to the process stream can be determined by a person of ordinary skill in the art. In one embodiment, up to about 1000 wppm of additive is added to the process stream. For example, the additive can be added such that its concentration, upon addition, is about 50 ppm, 250 ppm or 500 ppm. More or less additive can be added depending on, for example, the amount of particulate in the stream, the $\Delta T$ associated with the particular process and the degree of fouling reduction desired in view of the cost of the additive.

The additives or compositions of the present invention can be added in a solid (e.g. powder or granules) or liquid form directly to the process stream. As mentioned above, the additives or compositions can be added alone, or combined with other components to form a composition for reducing fouling (e.g. particulate-induced fouling). Any suitable technique can be used for adding the additive to the process stream, as known by a person of ordinary skill in the art in view of the process to which it is employed. As a non-limiting example, the additives or compositions can be introduced via injection that allows for sufficient mixing of the additive and the process stream.

EXAMPLES

The present invention is further described by means of the examples, presented below. The use of such examples is illustrative only and in no way limits the scope and meaning of the invention or of any exemplified term. Likewise, the invention is not limited to any particular preferred embodiments described herein. Indeed, many modifications and variations of the invention will be apparent to those skilled in the art upon reading this specification. The invention is therefore to be limited only by the terms of the appended claims along with the full scope of equivalents to which the claims are entitled.

Example 1

Synthesis of an Additive of the Present Invention—PP-E-PAM

A. Epoxidation of a Vinyl Terminated PP

A1. To a solution of vinyl terminated polypropylene ($M_w$ 1736, $M_n$ 468, NMR averaged molecular weight 982.99, assuming one olefin unsaturation per chain) (5.00 g, 5.087 mmol) in methylene chloride (50 ml) at 0° C. was added 3-chloroperoxybenzoic acid (77% purity, 1.31 g, 5.85 mmol, 1.15 equiv.) in small portions. The resulting mixture was stirred at 0° C. for 1 hr and allowed to warm to room temperature overnight with stirring. The mixture was washed with dilute 5% aqueous sodium bisulfite, 5% aqueous sodium bicarbonate, water, brine, and dried over anhydrous magnesium sulfate, filtered, and concentrated to give a colorless oil (4.83 g, 95%) as crude product. The structure and purity of the crude product was established by $^{1}H$ and $^{13}C$ NMR ($CDCl_3$, 400 and 100 MHz, respectively), which confirmed complete conversion of the vinyl group to the corresponding epoxy linkage.

A2. To a solution of vinyl terminated polypropylene ($M_w$ 850, $M_n$ 255, NMR averaged molecular weight 570.73, assuming one olefin unsaturation per chain) (20.00 g, 35.04 mmol) in methylene chloride (300 ml) at 0° C. was added 3-chloroperoxybenzoic acid (77% purity, 9.82 g, 43.80 mmol, 1.25 equiv.) in small portions. The resulting mixture was stirred at 0° C. for 1 hr and allowed to warm to room temperature overnight with stirring. The mixture was washed with dilute 5% aqueous sodium bisulfite, 5% aqueous sodium bicarbonate, water, brine, and dried over anhydrous magnesium sulfate, filtered, and concentrated to give a colorless oil (18.7 g, 91%) as crude product.

B. Functionalizing Epoxy Terminated PP with a Polyamine

Figure 3:
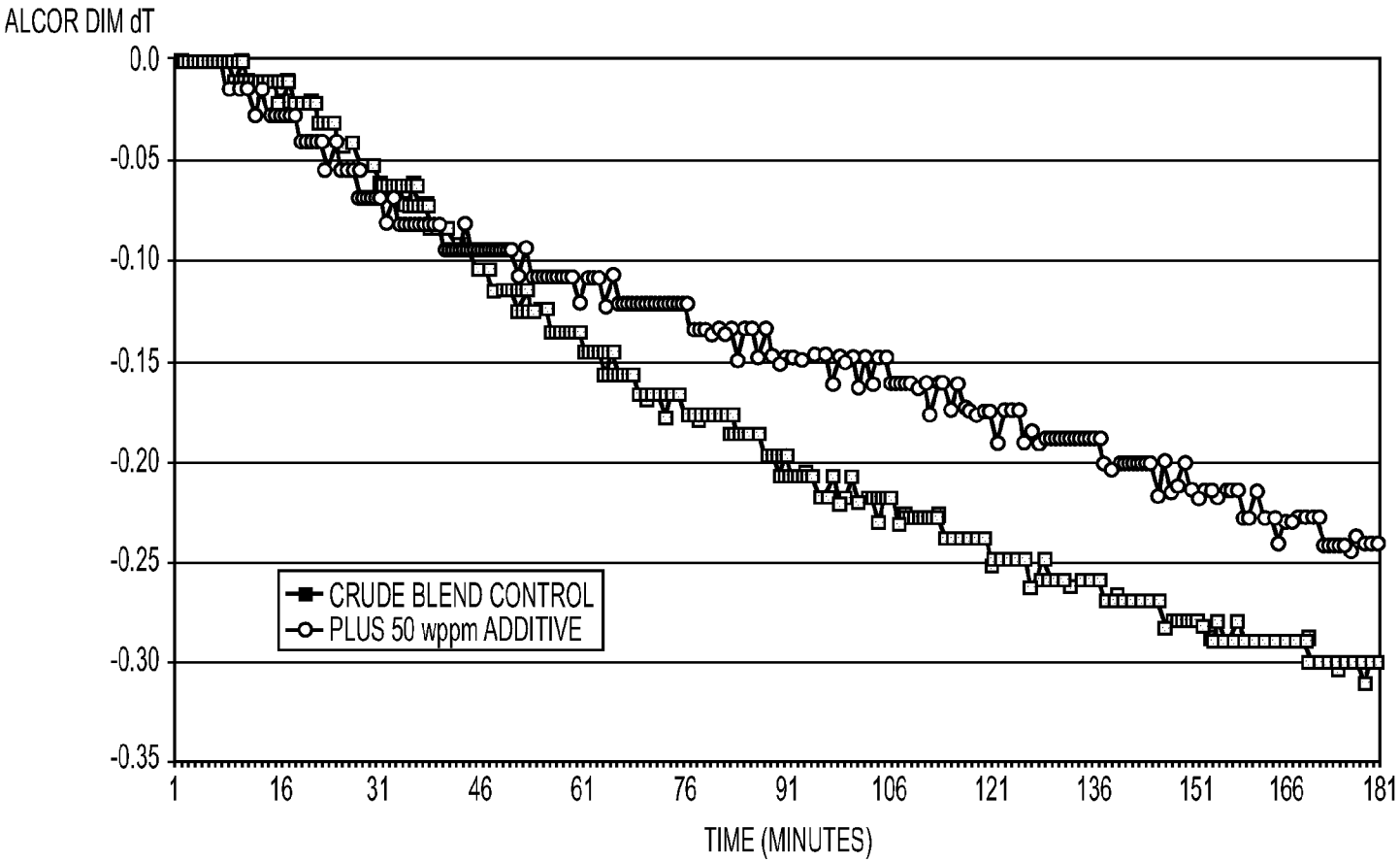
FIG. 3 is a graph demonstrating the effects of fouling of a control crude oil blend sample and a crude oil blend sample treated with 50 wppm of a polypropylene epoxy polyamine (PP-E-PAM) additive having a total nitrogen content of about 6.45 wt %, as measured by the Alcor HLPS apparatus depicted in FIG. 2.

B1. A mixture of polypropylene epoxy (3.30 g, 3.30 mmol) and pentaethylenehexamine (0.77 g, 3.30 mmol, 1.0 equiv.), toluene (15 ml) and absolute ethanol (200 proof, 15 ml) was heated at reflux under a nitrogen atmosphere for 60 hr. The mixture was concentrated on a rotary evaporator to afford a viscous pale yellow oil (4.00 g) as crude product. This product has a total nitrogen content of about 6.45 wt. %. The reduction in the fouling of crude oil caused by this additive is shown in FIG. 3.

Figure 4:
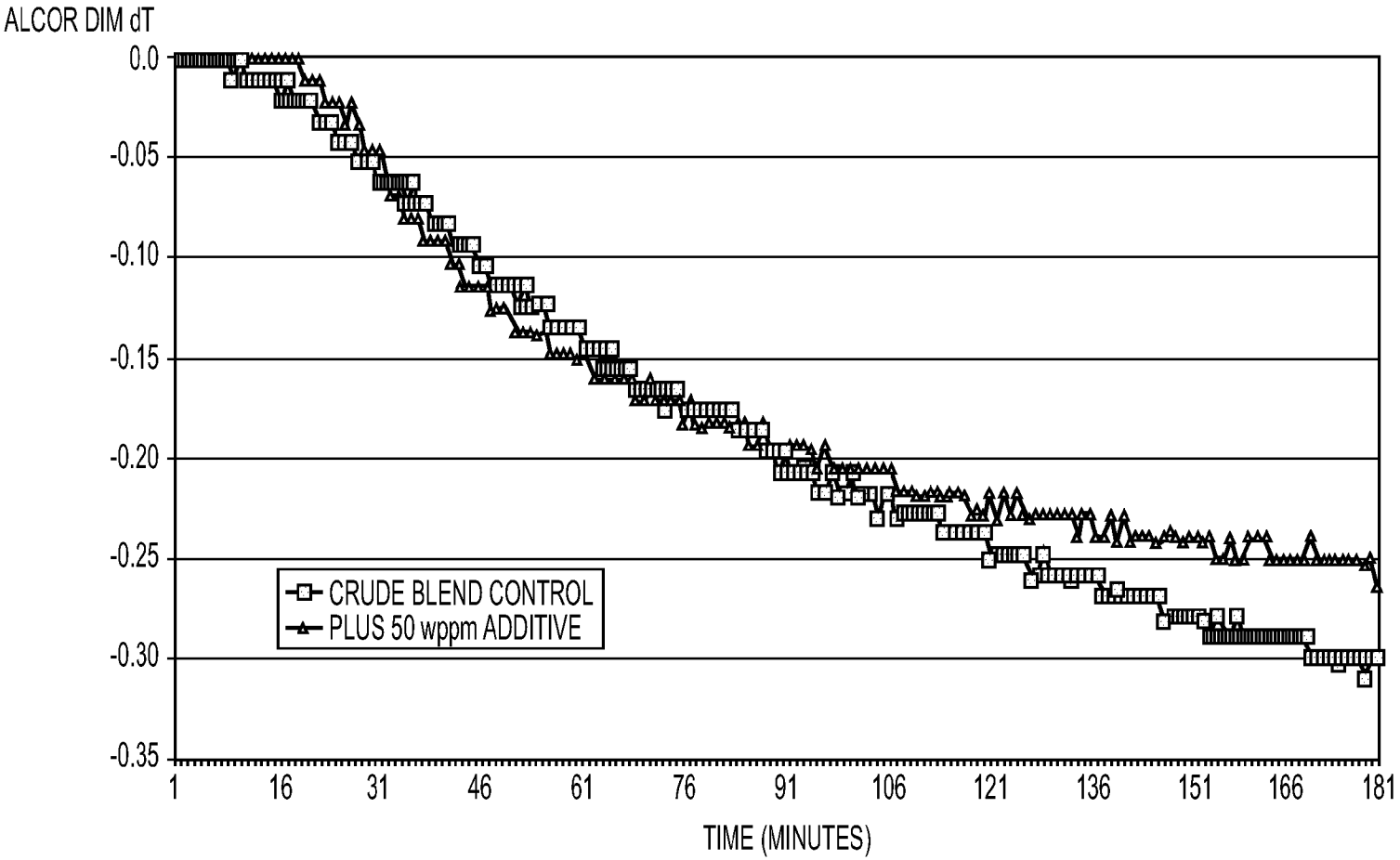
FIG. 4 is a graph demonstrating the effects of fouling of a control crude oil blend sample and a crude oil blend sample treated with 50 wppm of a polypropylene epoxy polyamine (PP-E-PAM) additive having a total nitrogen content of about 6.09 wt %, as measured by the Alcor HLPS apparatus depicted in FIG. 2.

B2. A mixture of polypropylene epoxy (5.00 g, 8.52 mmol, 1.4 equiv.) and tetraethylenepentamine (1.15 g, 6.08 mmol, 1.0 equiv.), toluene (10 ml) and absolute ethanol (200 proof, 10 ml) was heated at reflux under a nitrogen atmosphere for 720 hr. The mixture was concentrated on a rotary evaporator to afford a viscous pale yellow oil (6.00 g) as crude product. This product has a total nitrogen content of 6.09 wt. %. The reduction in the fouling of crude oil caused by this additive is shown in FIG. 4.

Example 2

Fouling Reduction Measured in the Alcor HLPS (Hot Liquid Process Simulator)

Figure 2:
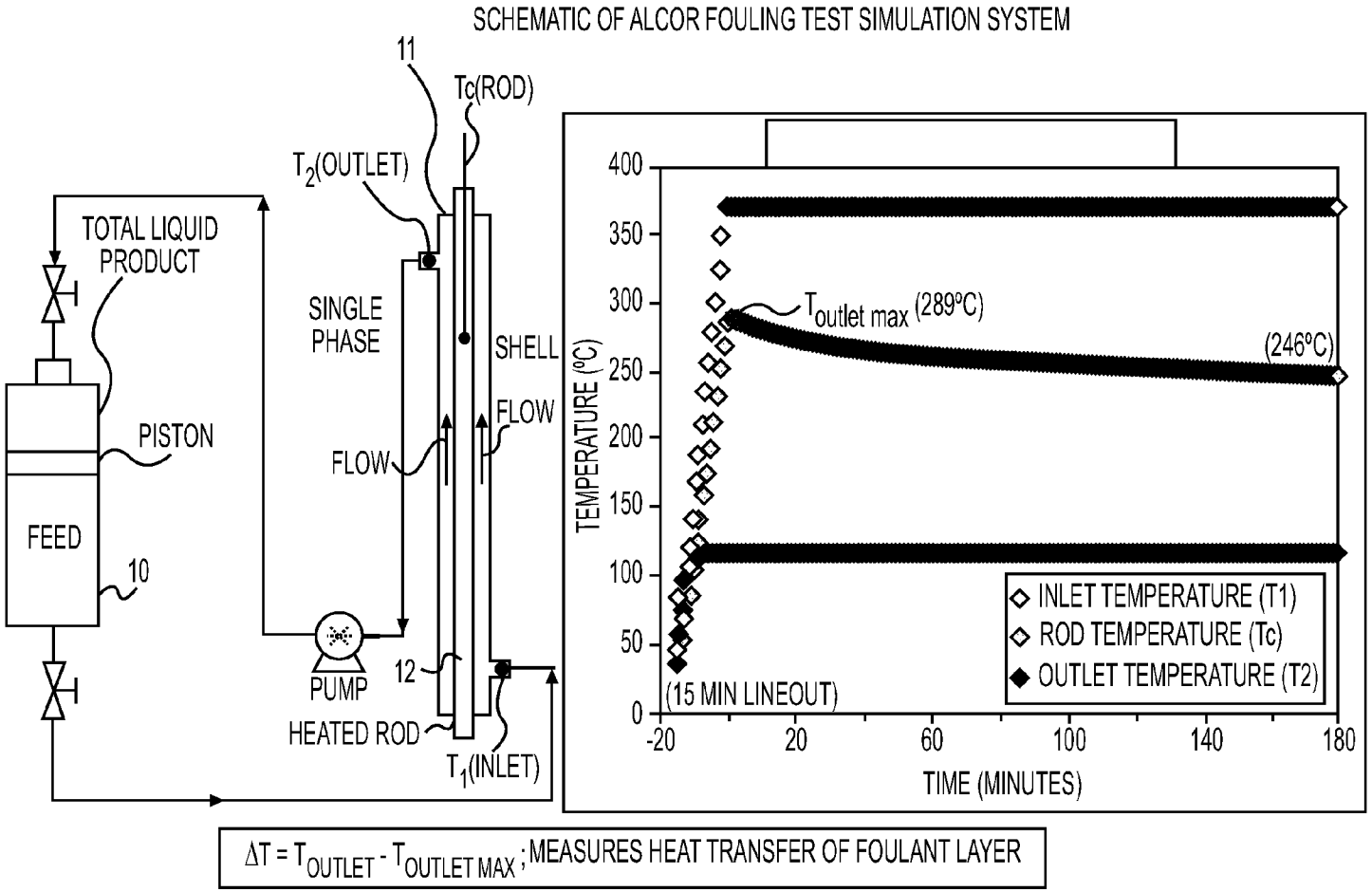
FIG. 2 is a schematic of the Alcor Hot Liquid Process Simulator (HLPS) employed in Example 2 of this invention. An exemplary fouling calculation is shown, and further described in Example 2, to demonstrate how the effects of the presently disclosed additives on particulate induced fouling can be ascertained.

FIG. 2 depicts an Alcor HLPS (Hot Liquid Process Simulator) testing apparatus used to measure the impact of addition of particulates to a crude oil on fouling and the impact the addition of an additive of the present invention has on the mitigation of fouling. The testing arrangement includes a reservoir 10 containing a feed supply of crude oil. The feed supply of crude oil can contain a base crude oil containing a whole crude or a blended crude containing two or more crude oils. The feed supply is heated to a temperature of approximately 150° C./302° F. and then fed into a shell 11 containing a vertically oriented heated rod 12. The heated rod 12 is formed from carbon-steel (1018). The heated rod 12 simulates a tube in a heat exchanger. The heated rod 12 is electrically heated to a surface temperature of 370° C./698° F. or 400° C./752° F. and maintained at such temperature during the trial. The feed supply is pumped across the heated rod 12 at a flow rate of approximately 3.0 mL/minute. The spent feed supply is collected in the top section of the reservoir 10. The spent feed supply is separated from the untreated feed supply oil by a sealed piston, thereby allowing for once-through operation. The system is pressurized with nitrogen (400-500 psig) to ensure gases remain dissolved in the oil during the test. Thermocouple readings are recorded for the bulk fluid inlet and outlet temperatures and for surface of the rod 12.

During the constant surface temperature testing, foulant deposits and builds up on the heated surface. The foulant deposits are thermally degraded to coke. The coke deposits cause an insulating effect that reduces the efficiency and/or ability of the surface to heat the oil passing over it. The resulting reduction in outlet bulk fluid temperature continues over time as fouling continues. This reduction in temperature is referred to as the outlet liquid ΔT or ΔT and can be dependent on the type of crude oil/blend, testing conditions and/or other effects, such as the presence of salts, sediment or other fouling promoting materials. A standard Alcor fouling test is carried out for 180 minutes. The total fouling, as measured by the total reduction in outlet liquid temperature over time, is plotted on the y-axis of FIG. 3 and FIG. 4 and is the observed outlet temperature ($T_{outlet}$) minus the maximum observed outlet $T_{outlet\ max}$ (presumably achieved in the absence of any fouling).

FIG. 3 illustrates the impact of fouling of a refinery component over 180 minutes. Two blends were tested in the Alcor unit: a crude oil control without an additive, and the same stream with 50 wppm of a PP-E-PAM additive (prepared according to the method in Example 1.B1). As FIG. 3 demonstrates, the reduction in the outlet temperature over time (due to fouling) is less for the process blend containing 50 wppm of additive as compared to the crude oil control without the additive. This indicates that the PP-E-PAM is effective at reducing fouling of a heat exchanger. FIG. 4 demonstrates the results of the Alcor test using another PP-E-PAM additive, (prepared according to the method in Example 1.B2). As FIG. 4 indicates, this PP-E-PAM was also effective at reducing fouling.

The present invention is not to be limited in scope by the specific embodiments described herein. Indeed, various modifications of the invention in addition to those described herein will become apparent to those skilled in the art from the foregoing description and the accompanying figures. Such modifications are intended to fall within the scope of the appended claims.

It is further to be understood that all values are approximate, and are provided for description.

Patents, patent applications, publications, product descriptions, and protocols are cited throughout this application, the disclosures of each of which is incorporated herein by reference in its entirety for all purposes.

The invention claimed is:

1. A method for reducing fouling in a hydrocarbon refining process comprising providing a crude hydrocarbon for a refining process;

adding an additive to the crude hydrocarbon, the additive being a reaction product of (a) a polymer base unit $R_{11}$, which is a branched or straight-chained $C_{10}$-$C_{800}$ alkyl or alkenyl group having a vinyl terminal group;

(b) an epoxidation reagent capable of converting the vinyl terminal group of $R_{11}$ to an epoxy group; and (c) a polyamine represented by Formula IV

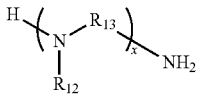

wherein $R_{12}$ is hydrogen or a $C_1$-$C_{10}$ branched or straight chained alkyl optionally substituted with one or more amine groups, $R_{13}$ is a $C_1$-$C_{10}$ branched or straight chained alkylene group, and x is an integer between 1 and 10 inclusive.

2. The method of claim 1, wherein the polyamine is selected from the group consisting of diethylenetriamine, triethylenetetramine, tetraethylenepentamine, pentaethylenehexamine, and hexaethyleneheptamine.

3. The method of claim 1, wherein $R_{11}$ comprises polypropylene.

4. The method of claim 3, wherein the mole ratio between $R_{11}$ and polyamine is about 2:1 or about 1:1.

5. The method of claim 3, wherein $R_{11}$ has a number-averaged molecular weight of 300 to 30000 g/mol.

6. The method of claim 5, wherein $R_{11}$ has a number-averaged molecular weight of 500 to 5000 g/mol.

7. The method of claim 3, wherein the polypropylene is atactic polypropylene or isotactic polypropylene.

8. The method of claim 1, wherein $R_{11}$ comprises polyethylene.

9. The method of claim 1, wherein $R_{11}$ comprises poly (ethylene-co-propylene).

10. The method of claim 9, wherein $R_{11}$ contains about 1 to about 90 mole % of ethylene units and about 99 to about 10% propylene units.

11. The method of claim 10, wherein $R_{11}$ contains about 10 to about 50 mole % of ethylene units.

12. The method of claim 1, wherein the epoxidation reagent comprises an organic peroxy acid.

13. The method of claim 12, wherein the organic peroxy acid is m-chloroperoxybenzoic acid (MCPBA).

14. The method of claim 1, wherein the epoxidation reagent comprises (A) an oxidation agent selected from the group consisting of molecular oxygen, hydrogen peroxide, and alkyl peroxide; and (B) an epoxidation catalyst.

15. The method of claim 14, wherein the epoxidation catalyst is selected from the group consisting of metalloporphyrin, a transition metal zeolite, and a transition metal complex.

16. The method of claim 1, wherein at least 50% of the terminal vinyl group is an allylic vinyl group.

* * * * *